United States Patent [19]

Gamm

[11] Patent Number: 4,550,511

[45] Date of Patent: Nov. 5, 1985

[54] INSTEP SUPPORT FOR FOOTWEAR

[75] Inventor: Robert J. Gamm, St. Louis, Mo.

[73] Assignee: Kangaroos U.S.A., Inc., St. Louis, Mo.

[21] Appl. No.: 487,881

[22] Filed: Apr. 22, 1983

Related U.S. Application Data

[63] Continuation-in-part of Ser. No. 319,682, Nov. 9, 1981, abandoned, and a continuation-in-part of Ser. No. 458,219, Jan. 17, 1983, abandoned, and a continuation-in-part of Ser. No. 481,165, Apr. 11, 1983.

[51] Int. Cl.[4] ..... A43B 11/00

[52] U.S. Cl. ..... 36/50; 36/91; 36/119

[58] Field of Search ..... 36/50, 91, 119, 120, 36/114

[56] References Cited

U.S. PATENT DOCUMENTS

| | | | |
|---|---|---|---|
| 1,139,530 | 5/1915 | Johnson . | |
| 1,286,787 | 12/1918 | Rokahr | 36/26 R |
| 1,539,762 | 5/1925 | Mussabini . | |
| 1,545,623 | 7/1925 | Westfall . | |
| 1,763,997 | 6/1930 | Williams . | |
| 1,986,580 | 1/1935 | Johnson . | |
| 2,539,761 | 1/1951 | Whitman | 36/2.5 |
| 2,925,672 | 2/1960 | Trovato . | |
| 3,028,861 | 4/1962 | Shapiro . | |
| 3,323,232 | 6/1967 | Danowsky | 36/91 |
| 3,327,410 | 6/1967 | Park et al. . | |
| 3,464,125 | 9/1969 | Conway | 36/114 |
| 3,530,594 | 9/1970 | Vogel . | |
| 3,703,775 | 11/1972 | Gatti . | |
| 3,768,182 | 10/1973 | Powers . | |
| 4,064,642 | 12/1977 | Vykukal et al. | 36/92 |
| 4,065,861 | 1/1978 | Pelfrey . | |
| 4,227,321 | 10/1980 | Kling et al. | 36/91 |
| 4,253,251 | 3/1981 | Salomon . | |
| 4,282,657 | 8/1981 | Antonious . | |

FOREIGN PATENT DOCUMENTS

| | | |
|---|---|---|
| 0047710 | 3/1982 | European Pat. Off. . |
| 0057170 | 8/1982 | European Pat. Off. . |
| 0063326 | 10/1982 | European Pat. Off. . |
| 0102842 | 9/1983 | European Pat. Off. . |
| 569694 | 4/1924 | France . |
| 201832 | 9/1923 | United Kingdom . |
| 207101 | 11/1923 | United Kingdom . |
| 261090 | 11/1926 | United Kingdom . |
| 333488 | 9/1930 | United Kingdom . |
| 336807 | 10/1930 | United Kingdom . |
| 465012 | 4/1937 | United Kingdom . |
| 1225359 | 3/1971 | United Kingdom . |
| 1422219 | 1/1976 | United Kingdom . |
| 1503684 | 3/1978 | United Kingdom . |

*Primary Examiner*—Werner H. Schroeder
*Assistant Examiner*—Mary A. Ellis
*Attorney, Agent, or Firm*—Paul M. Denk

[57] ABSTRACT

In an instep support for footwear, as for example in athletic shoes, strap or band member(s) extend upwardly and angularly forwardly from the insole, or the insole insert, for the shoe, and incorporate a fastening device at the band ends, so that they can be either secured together over the instep of the foot, or applied and held in place by connecting with the surface of a component of the shoe; the band members may also extend upwardly from an approximate central location for the insole, so that not only will the instep portion of the foot be embraced by the support, but the lateral portions of the arch will likewise be snugly retained by the elastic band members to assure full arch support in addition to a firm embracing of the instep of the foot as contained within the constructed shoe. In addition, a harness integrally connects with the band members and extends rearwardly therefrom for extending around the heel of the foot in order to enhance the support of the foot during application of the shoe.

13 Claims, 14 Drawing Figures

INSTEP SUPPORT FOR FOOTWEAR

CROSS REFERENCE TO RELATED APPLICATIONS

The subject matter of this application is related to and comprises a continuation-in-part of the applications of the same inventor, Ser. No. 319,682, filed on Nov. 9, 1981, now abandoned, application having Ser. No. 458,219, filed on Jan. 17, 1983, now abandoned, application having Ser. No. 481,165 and filed on Apr. 11, 1983, still pending, entitled Overlay Quarter Panel Support, with this application claiming status as a continuation-in-part application from said earlier applications, and all of which applications are owned by a common assignee.

BACKGROUND OF THE INVENTION

This invention relates generally to footwear, and enhanced support designed into their construction, and more specifically pertains to inherent support structured into the fabrication of such footwear, and in particular athletic shoes, so as to brace and strengthen one or more of the instep, arch, and heel portions of the foot as applied to this structured shoe.

Shoe designers have long desired to provide enhanced support for footwear, and particularly the shoes that are worn by the athlete, with the focus of the structural support being designed for strengthening of the ankle, instep, arch, and related orthopedic portions of the foot of the shoe wearer. And, more specifically, such designs in footwear have particularly been considered for the athletic style of shoes, and whether it be the type of shoe that may be used in jogging, or in strenuous athletic events such as during the sports of basketball, football, soccer, or the like, or perhaps even embodied in the design of skates, such as may be applied during participation in ice hockey, or the like. For example, in the early embodiments which were designed for providing enhanced support for the foot, generally that portion of the foot considered as requiring support was the ankle, and various devices were fabricated either for independent application to the ankle, or constructed into the structure of the shoe itself, which when applied, added strength and support for this aspect of the athlete's foot structure. As an example, in the U.S. patent to Shapiro, U.S. Pat. No. 3,028,861, it can be seen that an ankle supporter was provided, and for application directly to the foot, before it was ever inserted into any form of shoe, and particularly an athletic shoe. In addition, the U.S. patent to Bushway, et al, U.S. Pat. No. 2,942,359, discloses another article of footwear having an integral ankle and heel support means contained therein, and for the purpose of furnishing additional strength and support for the ankle of the athlete, and particularly, as explained therein, to those who participate in basketball, tennis, and other sporting events. The U.S. patent to Collis, U.S. Pat. No. 1,084,179, discloses another variation upon a style of ankle support and protector for particularly embracing the ankle of the athlete. Another early patented device is shown in the invention of Westfall, U.S. Pat. No. 1,545,623, and discloses an early variation upon means for including an ankle support within, and in this instance, a hockey boot, so as to enhance the strength of the ankle of the participant while partaking in this particular sporting event. A similar type of support means was shown in the U.S. patent to Johnson, U.S. Pat. No. 1,139,530, showing a skating and hockey boot wherein support was provided to both the ankle, and the upper ankle portion, in the vicinity of the shin, to add protection to the hockey enthusiast.

Various other structural supports, and which are more pertinent with respect to the invention disclosed herein, have been contemplated for usage within the athletic shoe, and not only for the purpose of providing protection and enhanced strength to the ankle of the athlete, but likewise, to furnish support at the vicinity of the arch and instep. For example, in the U.S. patent to Dankowsky, U.S. Pat. No. 3,323,232, a semi-resilient arch support is disclosed, being contained within a shoe, and which drapes upwardly around the sides of the foot, and being laced in place at the vicinity of the instep of the foot. This invention was devised for furnishing substantially rigid and semi-resilient cantilever type arch support, which do lace integrally within the lacing structure for the shown shoe, but which in the embodiment as shown such support apparently extends upwardly for integration, by means of stitching, to the inner vamp and quarter portions of the shown shoe. But, this particular shoe was design for the purpose of adding arch support to the construction of a shoe. Similar type of support is shown in the walking boot assembly disclosed in the Vykukal, et al, U.S. Pat. No. 4,064,642. In this particular instance, not only is arch support provided, but the draping of the heel strap around this portion of the foot for support is likewise provided therein. And, yet quite pertinent is the patent to Rokahr, U.S. Pat. No. 1,286,787, which is similar to the Dankowsky type of invention, wherein the athletic shoe incorporates a built-in pair of tongues for lacing internally of the athletic shoe to provide arch support. And, the patent to Park, Sr., et al, U.S. Pat. No. 3,327,410, shows related type of support, but particularly ankle support, within an athletic shoe, and comprising an integral flexible brace that wraps around the ankle, after elevating from the shoe sole, for furnishing support at the vicinity of the ankle of the athlete.

Various other styles of closure means, and which may yet be tightened in place about the shoe, for securement purposes, are shown in a series of U.S. patents to Famolare, Jr., U.S. Pat. No. 4,114,297, wherein the cinching strap is disposed externally of the shoe for draping over its lacing and being held by Velcro for securement of the shown athletic footwear. And, the patent to Antonius, U.S. Pat. No. 4,282,757, discloses a heel restraint within an adjustable and flexible closure assembly for a shoe, and in this particular instance an athletic shoe, and for use for the purpose of tightening the shoe in the manner as a stabilizer about the foot of the athlete. The U.S. patent to Hirsch, U.S. Pat. No. Des. 255,956, discloses fastening means for a sports shoe, and which replaces the usual style of lacing.

Of further interest to this current invention is the modification made to an athletic shoe, and more specifically in the orientation of its lacing for holding the shoe tightly in place, as disclosed in the U.S. patent to Larsen, U.S. Pat. No. 4,245,408, in addition to the second patent to Larsen, comprising U.S. Pat. No. 4,366,631. Both of these disclose an athletic shoe, and wherein the upper series of lacing extends downwardly towards the counter portion of the shoe, hooks through an eyelet thereat, so that when the lacing is tightened, it has a tendency to pull the heel portion of the shoe forwardly, for furnishing enhanced support and for effective usage for the shoe during application.

It is, therefore, in view of the foregoing, the principal object of the current invention to provide a series of conveniently oriented, and angulated band means, and which rise upwardly from the insole portion of the shoe, or its insole insert, for embracing both the lateral portions of the arch, and the instep, of the foot of the shoe wearer, in order to further tighten, but not uncomfortably, the wrap of the shoe about the foot of its wearer during usage.

Another object of this invention is to provide support means for use in structurally bracing a foot held within a shoe, as for example an athletic shoe, and which means incorporate a length dimension sufficient to provide some bracing and coverage upon the metatarsal, cuneiform, and navicular bones of the inserted foot.

Still another object of this invention is to provide a band means formed within a shoe that effectively wraps and embraces both the arch and instep portions of any foot applied therein.

Still another object of this invention is to provide a heel harness integrally structured with band means that both afford a bracing of the heel, instep, and arch portions for any foot contained within the shoe.

Yet another object of this invention is to form a band conveniently within an insole slot, or being adhered thereto, for draping upwardly around the sides of the arch, and snuggly adhering over the instep of any foot inserted within the shoe containing this invention.

Another object of this invention is to provide an instep support which has enhanced utility within an athletic shoe but yet remains comfortable in its application as during usage of the shoe during participation in a rather strenuous athletic endeavor.

Yet another object of this invention is to provide an elastic style of band that grips portions of the orthopedic bones formed of the foot to provide full and effective support, and give its wearer a direct sensory experience of possessing full arch support during application of the subject shoe.

Another object of this invention is to provide band means that may be formed with an insole insert and applied into a shoe for conveniently bracing the foot of its wearer.

Still another object of this invention is to provide band means that may be integrally structured into the insole portion of the shoe, and extend upwardly for securement with the shoe gusset, and to provide adequate bracing for any foot contained within the shoe, without too tightly binding of it, which would otherwise cause discomfort and excessive pressure upon the arterial aspects of the foot structure.

Another object of this invention is to prevent longitudinal sliding of a foot within a shoe so as to obviate the incurrence of turf toe.

These and other objects may become more apparent to those skilled in the art upon reviewing the summary of this invention, and upon undertaking a study of the description is its preferred embodiment, in view of the drawings.

SUMMARY OF THE INVENTION

This invention contemplates the application of particular structure within the fabrication of footwear, having special applications in the athletic shoe, or alternatively such advantages may be constructed into the formation of an insole insert, and provide some of the advantages to be attained from this invention for enhancing instep support for the foot applied to such a shoe. The shoe of this invention may be of the usual style, and regardless whether it be fabricated as a dress shoe, walking shoe, casual shoe, or preferably an athletic shoe. And, its structure contains the usual vamp, quarter, and counter portions, all integrally secured together with the shoe sole, and its insole.

The invention focuses upon the application of a band means, in the form of a support, that extends upwardly from the insole, preferably proximate its central portion, for furnishing a pair of band or strap members that snuggly, but not constrictingly tight, secures the foot within the shoe, before it is laced or otherwise tightened in place. The band members are preferably constructed of an elastic material, although effective tightness of the instep support about the foot may yet be obtained from the usual materials such as cloth, canvas, leather, or the like. The band members are angulated upwardly, and somewhat forwardly in the structure of the shoe, so as to embrace rather snugly around the lateral arch portions of the foot, and are directed towards the front of the foot for lapping over its instep portion, so as to afford full structural support and embracement of the various orthopedic bone structures of the foot, forwardly of the ankle, and to comfortably provide the wearer with a direct sensory experience of attaining full arch and instep support during application and usage of the shoe, particularly when the footwear comprises an athletic shoe, and when the wearer participates in the rather strenuous athletic events, as previously alluded to. In addition, this invention compensates greatly for varying widths of the foot within a shoe, and particularly an athletic shoe, which has a tendency to be manufactured to lesser width sizes.

These band members extend upwardly within the shoe structure, interiorly thereof, and are arranged somewhat contiguous with the inner surfaces of the shoe quarter portions, and at their upper free ends may contain retention means, such as Velcro, so that the band ends may be secured together, after being pulled reasonably snuggly about the foot, or in the preferred embodiment, such band ends may adhere with a similar form of retention means, such as Velcro, that may secure upon the upper surface of the shoe gusset, that normally overlies the instep of the inserted foot. In this latter embodiment, the band ends terminate short of overlapping themselves, but rather, simply drape upwardly around the sides of the foot, and connect proximate opposite segment or edges of the shoe gusset, after having been snuggly tightened in place, so as to integrate the application of the gusset itself into the type of support that may be obtained and desired for the arch and instep support of this invention.

In another embodiment, the band means, or more particularly each of its band members, has a heel like harness integrally connecting and extending rearwardly therefrom, for encircling the back edge of the ankle, and thereby furnish further means for bracing the entire foot structure, so as to not only afford enhanced support for the arch and instep thereof, but likewise to provide medically desirable bracing of the ankle itself, as at the location of its heel, for providing a form of triangulated support for these three components about the foot in full, to assure not only the feel of tightness of the shoe about the foot, but to further strengthen the support of the foot so as to prevent any detrimental twisting or turning under that frequently occurs to the athlete, and which action usually leads to a sprain or breakage thereof.

The application of these principles appended to an insole insert, so that even though the owner of a pair of shoes may not have the structure of this invention built into it, as in the preferred embodiment, may be obtained subsequently for insertion into the shoe structure, and applied for obtaining the desired benefits therefrom. And, preferably, the band means may also extend from a central portion of the insert, so that the advantages to be derived from its wraparound of the foot may also be obtained with respect to its arch, in addition to providing the desired embracing of the instep portion of the foot.

DESCRIPTION OF THE PREFERRED EMBODIMENT

Figure 1:
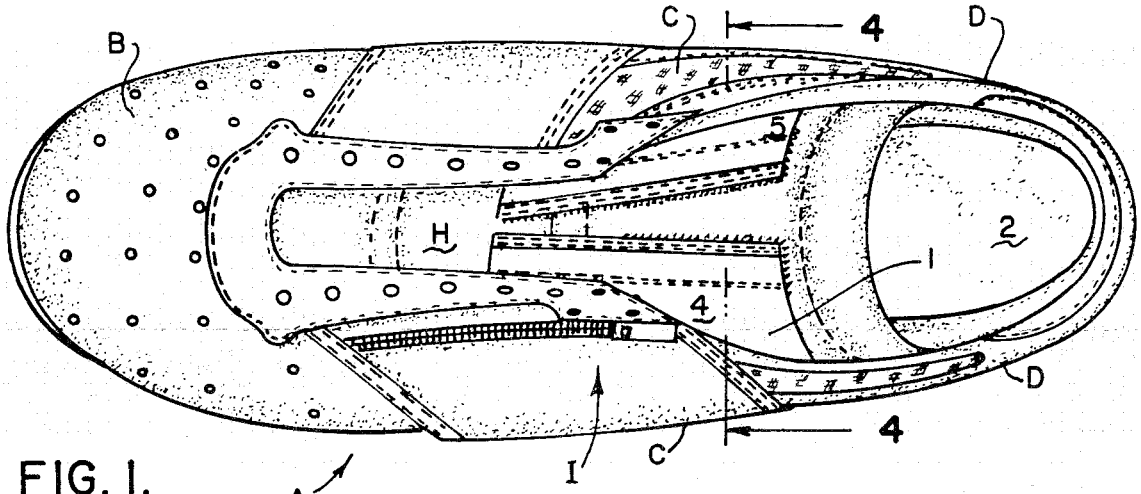
FIG. 1 provides a plan view of a shoe, incorporating the instep support of this invention.
Figure 2:
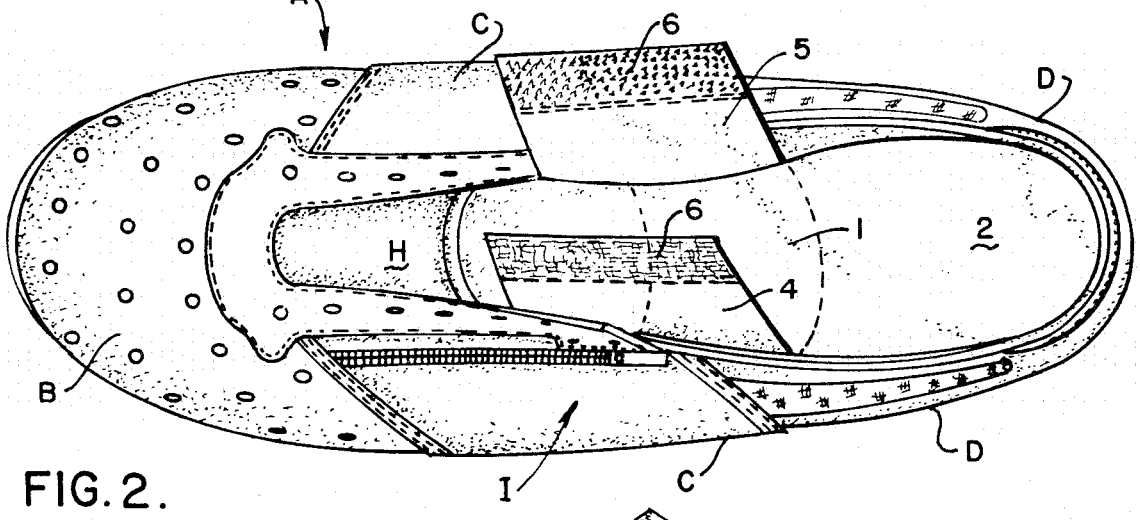
FIG. 2 provides a plan view of the same shoe shown in FIG. 1, but disclosing the instep support partially folded but yet open as during its application.
Figure 3:
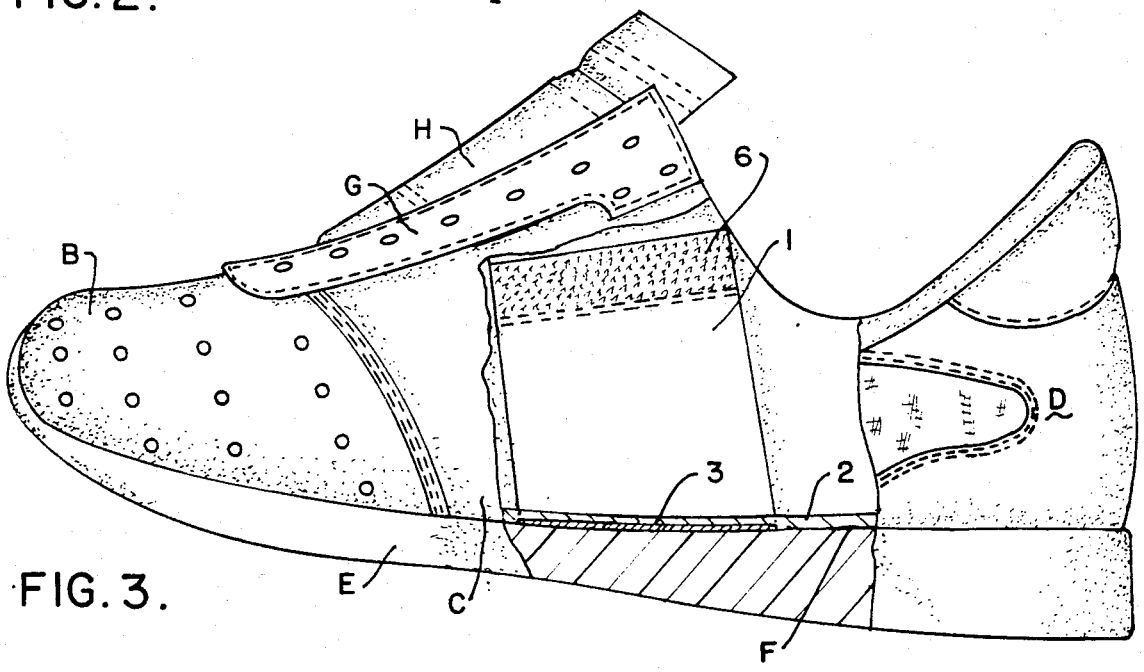
FIG. 3 provides a side view of the shoe shown in FIG. 1, disclosing, through a removed portion, the angulated arrangement of the instep support therein.

In referring to the drawings, and in particular FIGS. 1 through 3, there is shown a style of footwear, in this particular instance, comprising an athletic shoe, as of the type that may be used in jogging, basketball, and football, or in other athletic events. In addition, the features of this invention may likewise be embodied in casual shoes, or in other types of footwear, wherein full support for the various orthopedic structure of the foot is required for the benefit of the wearer.

The shoe, as shown, is formed having the usual components containing the shoe upper A, formed of the vamp portion B, which in this particular instance, may have the various toe piece, tip, and the vamp, all integrally constructed together and forming the forward portion for the shoe upper, as shown. In addition, the shoe contains a pair of quarter portions C, provided to either side of the shoe, or laterally thereof, and connecting with the heel or counter portions D, as shown. All of these components are secured tc a sole portion E, as along the sole shank, F, as the shoe is integrated into a complete structure. An eyestay G is formed along the upper portion of the shoes, and within the region intermediate the pair of eyestays provided at the upper edge of each quarter portion, is the shoe gusset or tongue H, as can be seen.

Also disclosed provided upon one of the quarter portions for this particular shoe, as depicted in these drawings, is a formed pocket part, as at I, in the style of shoe fabrication that has been foremost in the design efforts of this inventor.

As can also be seen from these figures, a support system for the shoe is generally depicted at 1, comprising a band means that is integrated into the insole portion 2 for the shoe, and extends angularly upwardly, and forwardly within the shoe, to provide for its emplacement overlying the instep portion of any foot inserted into the shoe during its application. The essence of this invention is to provide this type of a band means support that is generally arranged cooperating with the insole, or the insole insert, for the shown shoe, and arranged at a position where the secured or otherwise retained portion of the band means will be disposed approximately centrally under the arch of the emplaced foot, and then angulates the band means forwardly, as shown, to provide for an overlying of the entire, or approximately entire, instep portion for the located foot, in order to provide overlying support and coverage upon the orthopedic structures of the foot located therebeneath, and forming the instep, such as at the location of the first metatarsal bone, the internal cunieform, and the navicular bones located at this portion of the foot. Thus, full arch support is provided, in addition to providing properly placed embracing of the instep, so that the foot will be totally supported, conveniently gripped and hugged by means of this band means, in addition to being firmly held in place within the shoe, such as the shown athletic shoe, during its usage and application.

It can be seen in this particular construction, as in FIG. 3, that the band means 1 is formed extending under the insole portion 2 for the shoe, as can be seen at 3. In addition, and in this particular embodiment, the band means 1 forms a pair of upward extending band members 4 and 5, so as to conveniently place their ends either in overlying fashion, or in close abutting relationship, contiguously upon the instep portion of the foot. In addition, and as can be seen from FIG. 2, the approximate ends for each of these band members 4 and 5 contains a retention means, as at 6, in this particular instance comprising a hook and pile retention means, generally identified in the trade as Velcro, so that the ends of the band means can be conveniently linked together, or as shown in the preferred embodiment, as in FIG. 1, will cooperate with similarly contained retention means, such as Velcro, that is emplaced upon the upper surface of the shoe gusset H, as disclosed. Thus, and in referring to this FIG. 1, the structure of this invention, and in its preferred embodiment, will simply effect a pulling of the upper ends of both of these band members 4 and 5 into an upward and wraparound position, over the instep of the foot, and likewise over the structure of the shoe gusset H, and once pulled to the desired tightness, can be locked into position for retention upon the shoe gusset, as shown herein. Thus, and since the gusset for this particular style of shoe is normally constructed containing adequate padding, so as to add softness to the emplacement of the gusset in overlying the instep of the associated foot, these band members 4 and 5 while providing tight bracing around the sides of the foot, and into the region of the instep, will be held in place by means of the gusset, sufficiently urge the gusset into a snug overlying relationship upon the instep of the foot, and therein furnish a conveniently integrated bracing of the entire foot through the association of not only the insole arch portion of the shown shoe, but likewise furnish the same through the agency of the lateral band members 4 and 5, in addition to the downwardly pressured gusset H, to which the band members adhere.

Figure 4:
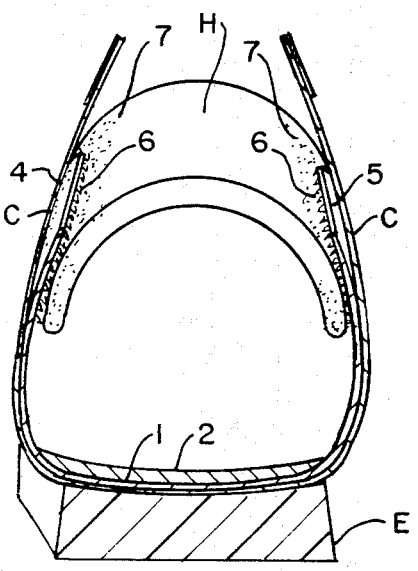
FIG. 4 provides a transverse sectional view at approximately the mid point of the shoe and disclosing the arrangement of the instep support as adhered with the gusset for the shown shoe.

Various styles of designed support systems, and in particular band means for fabrication into the shoe styles, are envisioned for this particular invention. For example, and as can be seen in FIG. 4, the band means 1 extends fully under the insole portion 2 for the shown shoe, and disposes its band members 4 and 5 upwardly, contiguously along the interior surface of the quarter portion C for the shown shoe, towards the region of the gusset H, for providing some overlapping thereof, and the connection of its retention means, such as the Velcro 6, into connection with similar type of retention means provided upon the upper surface of the gusset H. Such Velcro for the shoe gusset can be seen at 7.

Figure 5:
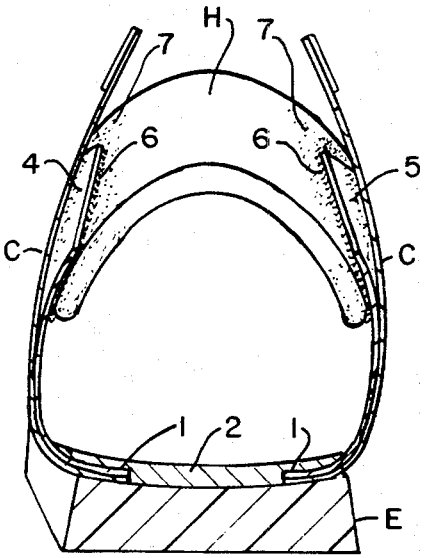
FIG. 5 provides a similar view to that shown in FIG. 4, and shows that the instep support may be fabricated from a pair of band members.

In another embodiment, as shown in FIG. 5, the band means 1 is actually formed from a pair of band members, 4 and 5, and terminate just under the edges of the insole portion 2 for the shown shoe, and are lasted in place thereat. But, the upper edges of the band members 4 and 5 secure similarly with the shoe gusset H, in the manner as previously explained with respect to the structure of the shoe as shown in FIG. 4.

Figure 6:
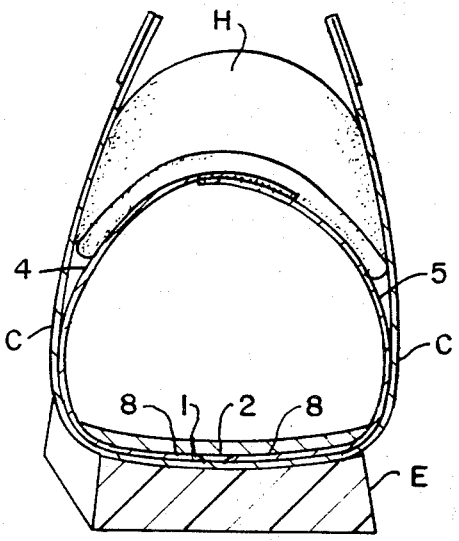
FIG. 6 provides a similar view to that shown in FIG. 4, but discloses how the band means secures through a central portion of the shoe insole, and extends upwardly for tightening about the instep of the foot.

In FIG. 6, another variation upon the connection of the band means 1 of this invention, and its integration into the shoe structure, is disclosed. In this particular instance, the band means 1 is formed as a unitized member, and extends downwardly and overlaps the side edges of the shoe insole 2, but then at its central portion, extends either under the said insole, or connects therewith, in order to obtain some retention to the insole and be structured into the fabrication of the shown shoe. The real advantage to this particular style of band means connection, and which actually affords that structure of connection desired for the preferred embodiment, is that those parts of the band members 4 and 5 that extend over the insole portions 2, as at 8, are free to provide further wrap and gripping of the arch areas of the foot, so that not only will the support system of this invention effectively grip the sides of the foot, and snuggly adhere to the instep portion, in overlying fashion, but likewise, full arch support is provided due to the wraparound of these lower segments 8 of the band means as tightened into position under the location of the arch of the foot disposed within the shown shoe during usage. It may be stated herein that it is this particular style of band means connection with the insole of the shoe, as shown in this FIG. 6, as used in conjunction with the type of band member connection, as at 4 and 5, upon the upper surface of the shoe gusset H, as shown in FIGS. 4 and 5, which is desired for the preferred embodiment when this particular invention is integrated into the fabrication of an athletic or other style of footwear. This particular combination, as defined for the preferred embodiment, totally encloses both the instep and the arch areas for the embraced foot, and thoroughly provides not only full structural support for the enclosed foot, but likewise gives the shoe wearer a direct sensory experience of having full arch support from the fitted shoe. In essence, it gives the wearer the impression that the shoe is so snugly adhered to the foot, so as to become a part of it, but yet not become so tightly bound thereto, due to the combined efforts of the shoe gusset H, and its retention with the band members 4 and 5 thereupon, so as to cause any constriction of any artery located within the instep portion for the embraced foot.

Figure 7:
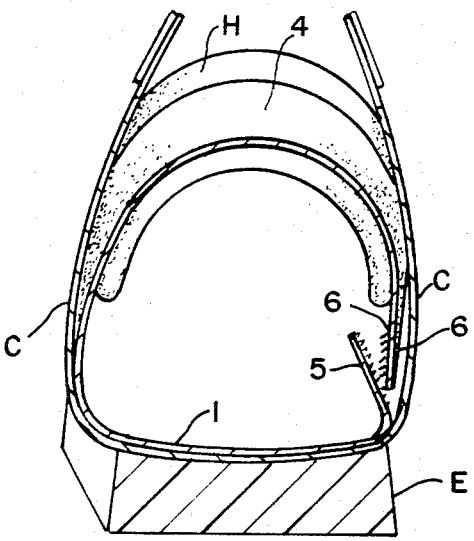
FIG. 7 provides a similar sectional view to that taken in FIG. 4, but showing how the band means surrounds the instep of the foot and connects proximate its side edge.

Another style of band means for adhering with the foot is shown in FIG. 7. As disclosed herein, the band means 1 secures upon the insole portion for the shown shoe, or it can be located thereunder, or perhaps even may be fabricated in the manner shown in FIG. 13, for connecting only along a central dimension of the insole, and then extends upwardly substantially along its band member 4, for draping over the shoe gusset H, or perhaps thereunder, for securement with the oppositely disposed band member 5, and for retention therewith, as through the interconnection of the retention means 6, such as the Velcro, as shown.

Figure 8:
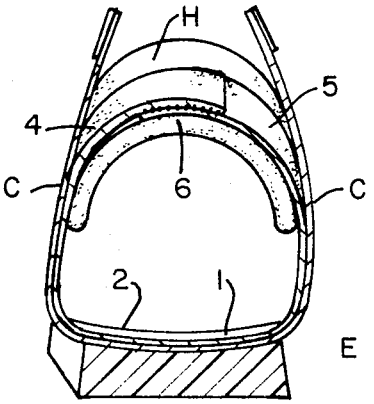
FIG. 8 provides a plan view of an insole insert incorporating the band means of this invention.

FIG. 8 discloses a further means for connection of the support system of this invention into the shoe structure. As disclosed, the band means 1 inserts under the insole portion 2, or may be secured thereto in the manner as also shown in FIGS. 5 and 6, and then locates its band members 4 and 5 upwardly therefrom for overlying upon the shoe gusset H, and being retained in place by means of any type of retention means, such as the Velcro 6, as shown.

Figure 9:
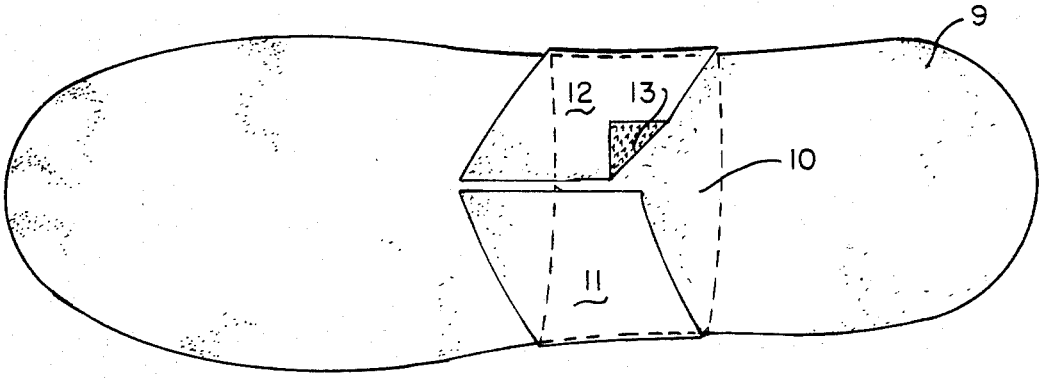
FIG. 9 provides a side view thereof.
Figure 10:
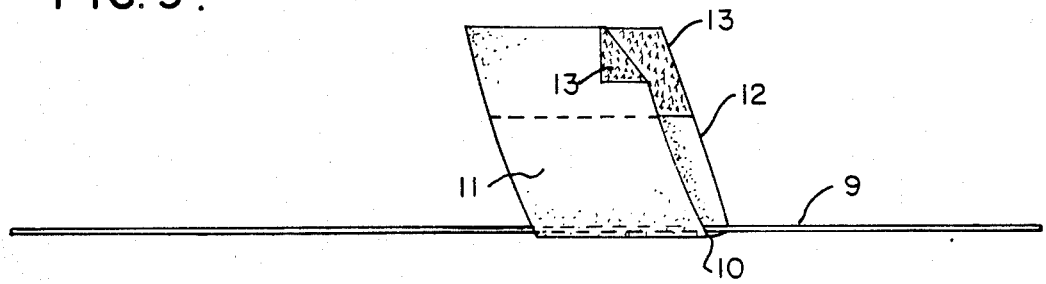
FIG. 10 provides a plan view of an insole insert disclosing how the band means attaches approximate a central portion thereof.

While the description of the fabrication of the band means of this invention into the structure of the fabricated shoe, and more specifically as operatively associated with the insole portion 2 for the shown shoes has just been described with respect to the embodiments disclosed in FIGS. 4 through 8, it is just as likely that these type of interconnection between the band means, and the insole portion of the shoe, can likewise be done with respect to an insert, of the type that may be inserted within the shoe, after having been independently purchased by the user or otherwise. For example, in FIGS. 9 and 10, an insole insert 9 is disclosed, and contains, as shown as already secured therewith, a band means 10, which provides a pair of upwardly disposed band members 11 and 12, containing retention means proximate there upper edges, as shown as the Velcro at 13, for securement overlying the instep of the foot. It should be obvious that these band members 11 and 12 may overlap each other, and have conveniently placed Velcro for retention of these band ends together, or in the alternative, there may be likewise sold with this insert a small piece of Velcro, that may be pressure adhesively applied to the surface of the shoe gusset, in order that the band member ends may be secured upon and retained with the shoe gusset, when tightened place, in the manner as shown and previously described with respect to the band member ends 4 and 5 as previously explained with respect to the shoes described in FIGS. 4 and 5. The side view for this particular construction is also disclosed in FIG. 10, and it can be seen, once again, in adopting the spirit of this invention, that the band means, at its insole location, is arranged approximately under the location where the arch of the foot is disposed, but then extends angularly upwardly, and forwardly, for draping over and for wrapping around the instep portion of any foot associated therewith.

Figure 11:
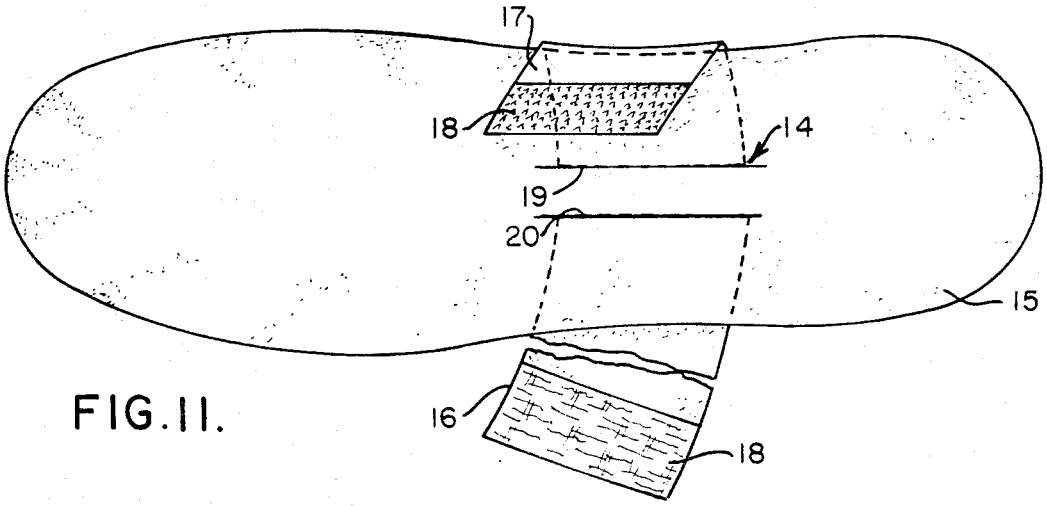
FIG. 11 provides a side view thereof.
Figure 12:
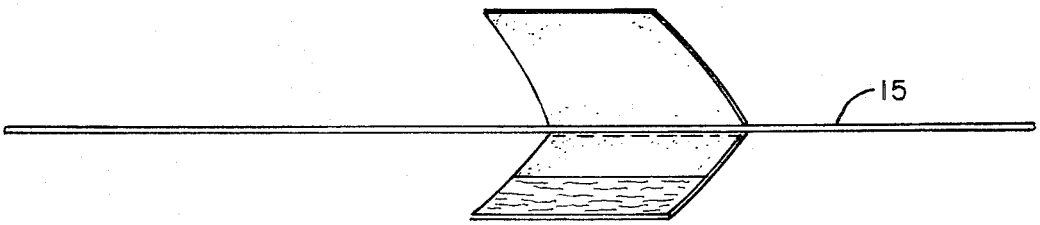
FIG. 12 provides a plan view of an insole insert and showing how the band means extends for some length along its longitudinal dimension.

Another variation on an insole insert is disclosed in FIGS. 11 and 12. In this particular embodiment, the band means 14 connects approximately at the central and along the length dimension of the insole insert 15, and contains a pair of upwardly extending band members 16 and 17 having retention means 18 associated therewith, such as Velcro, for either interconnection of the band ends together, in the manner as shown in FIGS. 6 and 8, or to provide for their interconnection and retention with the shoe gusset, as disclosed in FIGS. 4 and 5. As can also be herein seen, the band means 14 may be comprised of a pair of band members, and stitched in place along a central dimension of the insole insert, or the insert may contain a pair of slots, as approximately along the edges 19 and 20, and through which the band means 14 may insert, for providing engagement with the insert, but furnishing that freedom for the band members as they extend upwardly from the insert for embracing also, almost fully, the arch areas of the foot, in addition to the instep for the same, in the manner as previously described.

Figure 13:
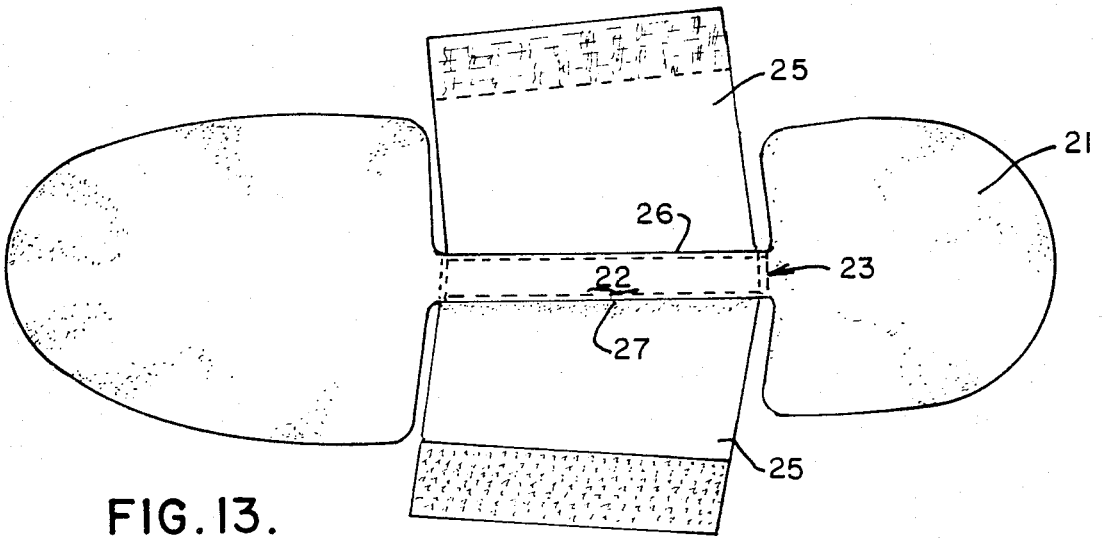
FIG. 13 provides a side view of a shoe, partially broken away in order to disclose the band means of this invention, and the heel harness integrally associated therewith.

Another means for fabrication of the insole insert for this invention is shown in FIG. 13, and in this particular instance, the band means 21 is substantially narrowed along a central and longitudinal dimension, as at 22, and has the band means 23 secured therewith, either stitched under it in place, or upon it, so as to provide band members 24 and 25 that may extend laterally and wraparound the arch portions of the foot, in addition to providing a full wraparound of the lateral edges of the foot, and be embraced upon the instep, either overlying the same, or perhaps securing with the gusset, in the manner as explained with respect to the band members shown in FIGS. 4 and 5, for providing a full wrap of the arch and instep portions of the foot, located within any shoe embodying the principles of this invention as disclosed herein. In order to minimize any bulk at the location where the band means 23 extends from under the length portion 22 of the insole insert, the edges, of the narrowed central portion 22, as at 26 and 27, may be skived, in order to alleviate any inconvenience otherwise produced due to the double thickness of materials at this location, as a result of the overlying relationship between the central portion 22, and the means 23, arranged thereunder, or upon the same. It should also be noted from this particular figure that the band means 23 for this invention is of substantial length, along the length dimension of the shoe, and therein provides a full wraparound of the entire arch portion of the foot, in addition to furnishing full overlying relationship tightly upon the various orthopedic structures as previously defined embodied within the instep portion of any foot. In addition, and while the embodiment of this particular invention, as disclosed in this FIG. 13, has been described as an insole insert, it is just as likely that it may form the insole portion itself, for the athletic shoe, of the type as previously described as being integrated within the fabrication of the shoe shown and previously described in FIGS. 1 through 3. It may be commented that the band means may be associated with the insole of the shoe at varying locations. For example, one band means may be connected with the insole at a central portion of the insole as shown in FIG. 13, but the other side of the band means may extend up from an edge thereof, as shown in FIGS. 4 thru 8.

Figure 14:
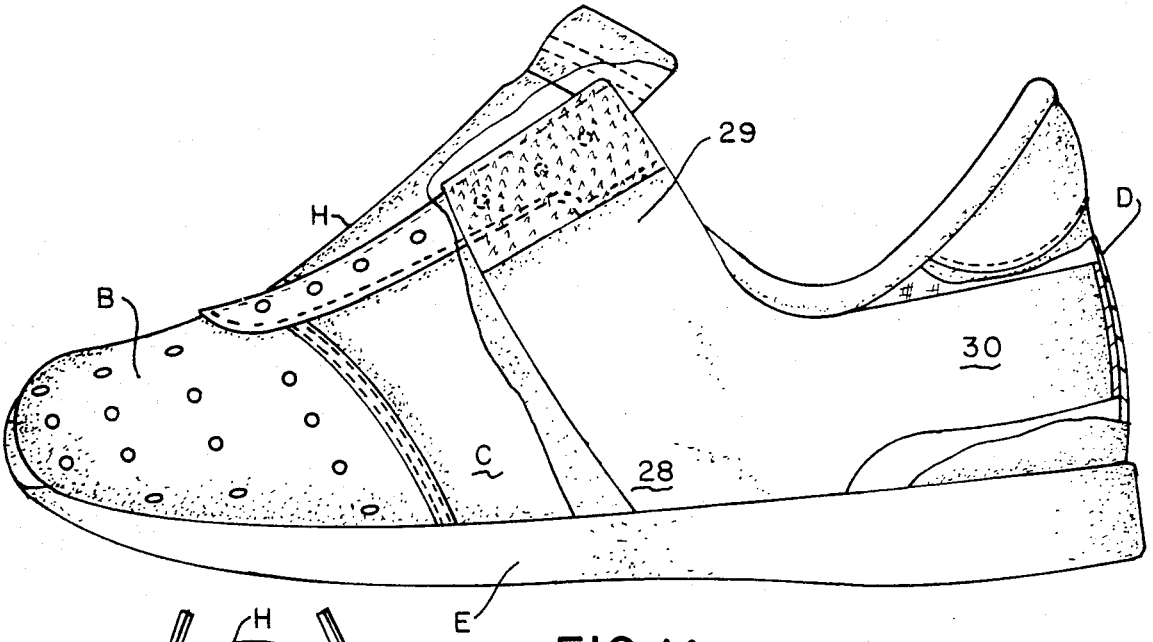
FIG. 14 provides a sectional view at approximately the mid point of a shoe and disclosing how the band means overlappingly connects upon the shoe gusset for bracing the instep of any foot located within the shown shoe.

A final embodiment for this particular invention is shown in FIG. 14. As disclosed, the shoe is of the usual structure as previously defined with respect to the footwear explained in FIG. 1, but in this particular instance, the support system incorporating the band means 28 includes a pair of band members, one as shown at 29, for extending upwardly, at both interior sides of the shoe, and which connect at their upper ends either with each other, or upon the gusset, in the manner as previously explained with respect to the invention as described in FIGS. 4 through 8. In addition, the bottom of the band means 28 may secure to the insole, its insert, and in the variety of ways as also disclosed in the FIGS. 4 through 8, in addition to the FIGS. 9 through 13.

This invention further comprehends the connection of a heel harness, as at 30, that integrally secures with the band means 28, and extends rearwardly thereof, approximately along the inner surface of the shoe heel, so as to provide a means for wrapping around of the heel and lower ankle portion of the foot, so as to integrate the bracing of the foot entirely at these locations, in a rather triangulated fashion, so as to provide a snug contraction and three point pressure upon the foot, during embracement, as at the vicinity of the heel, the arch, and its instep. The harness 30 extends, as can be seen, rearwardly from the band member 29, as on one side of the shoe, around the heel portion of the shoe, at its interior location, and integrally connects with the other and similar band member (not shown) provided at the opposite side just interiorly of the quarter portion for the shoe thereat. And, as explained, this three point pressure applied support system, which is rather triangulated for directing the forces of the system from the rear, as upon the heel, from the underside, is upon the arch, and being angulated downwardly and rearwardly, as upon the instep, focuses the bracing of the foot, located within the shoe, at the focal point of its pronation, and where the greatest support is desired so as to prevent occurrence of any detrimental injury to, particular the athlete, while strenuously participating within any sporting event.

As previously explained, all of the structures, and embodiments therefor, in addition to its variations, can be integrated into the shoe structure itself, for connection with its insole, or for use in conjunction with an insole insert, that may be later inserted into the shoe just prior to its application. In addition, and to prevent a too tight of a binding of this support system about the foot, its components may be structured from elastic material so as to provide a direct hugging effect in the embracement of the foot within the shoe, and prevent any cramping or too tight of binding of the support thereon during usage. The elasticized support system provides comfort, and yet the feel of structural support, for the foot, and provides that desired sensory feel of having full arch support, without detrimentally incurring a too tight of binding of the foot structure, which could otherwise cause puffing or swelling particularly at the location where arteries line the instep portion of the foot.

Variations or modifications to the structure and application of the support system for this invention may occur to those skilled in the art upon reviewing the subject matter of this disclosure. Such variations, if within the spirit of this invention, are intended to be encompassed within the scope of any claims to patent protection issuring hereon. The description of the preferred embodiments set forth herein are done so for illustrative purposes only.

Having thus described the invention what is claimed and desired to be secured by Letters Patent is:

1. In an instep support for footwear, and being a shoe of the type having an upper incorporating a vamp, quarter and heel portions, all securing together and being integrally connected with the shoe sole, a gusset provided within the shoe upper, an insole applied upon the shoe sole, the improvement which comprises, a support system provided within the shoe and useful for furnishing of support for the instep, arch, and associated components of the foot of the wearer, said support system including band means extending upwardly from the insole and arranged for overlying substantially the entire instep for the foot and being snugly secured therewith for bracing the foot within the applied shoe, said band means operatively associated with the insole means for the shoe and extending upwardly therefrom for also embracing the lateral arch portions of the foot in conjunction with the application of bracing to its instep, said band means incorporating a pair of band members, at least one of said band members extending upwardly from the insole means substantially inwardly from its lateral edge to also embrace the arch portion of the contiguous foot of the shoe wearer, said insole means having a central portion, said central portion of the insole means having a pair of slots formed therethrough, the band means inserting through said pair of slots for underlying the central portion of the insole means intermediate said pair of slots, said band means projecting upwardly through said slots and extending upwardly along the lateral portions of the arch and around the instep of the foot of the shoe wearer.

2. The invention of claim 1 and wherein said footwear comprises an athletic shoe.

3. The invention of claim 1 and wherein said band means having a dimension along the length of the shoe to overlie and embrace the metatarsal cunieform, and navicular bones of the foot.

4. The invention of claim 1 and including a heel harness integrally connecting with and extending rearwardly from the band means and also embracing the heel of the foot during shoe usage.

5. The invention of claim 1 and wherein said band means being of unitized construction.

6. The invention of claim 1 and wherein said band means comprises a pair of band members, each band member securing with one of the shoe sole and insole, and each extending upwardly therefrom for embracing the instep of the foot of the shoe wearer.

7. The invention of claim 1 and wherein said band means in its upward extension angulates forwardly within the structure of the shoe.

8. The invention of claim 1 and wherein said band means extends upwardly as a pair of band members contiguously along the inner sides of the shoe structure, one of said band members having retention means provided proximate its end, the other band member extending over the instep of the foot and including retention means proximate its end and dispose for securing with the retention means of the first said band member.

9. The invention of claim 1 and wherein said band members secure together under the shoe gusset.

10. The invention of claim 1 and wherein said band members secure together overlying the shoe gusset.

11. The invention of claim 1 and wherein said band members are formed of elastic material.

12. The invention of claim 1, and wherein said central portion of the insole means intermediate the pair of slots having formed edges thereat, and said edges being skived for minimizing any discomfort to the shoe wearer at the location where the band means projects through the formed slots of the insole means proximate its central portion.

13. The invention of claim 8 and wherein said retention means comprises hook and pile retention means.

* * * * *